US010658136B2

(12) United States Patent
Chiu et al.

(10) Patent No.: US 10,658,136 B2
(45) Date of Patent: May 19, 2020

(54) BUTTON STRUCTURE AND ELECTRONIC DEVICE USING SAME

(71) Applicant: Chiun Mai Communication Systems, Inc., New Taipei (TW)

(72) Inventors: Peng-Yu Chiu, New Taipei (TW); Ching-Chu Huang, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 0 days.

(21) Appl. No.: 16/058,422

(22) Filed: Aug. 8, 2018

(65) Prior Publication Data

US 2019/0096607 A1 Mar. 28, 2019

(30) Foreign Application Priority Data

Sep. 27, 2017 (CN) ..... 2017 1 0891646

(51) Int. Cl.
*H01H 13/86* (2006.01)
*H01H 13/88* (2006.01)
*H01H 13/84* (2006.01)

(52) U.S. Cl.
CPC ..... *H01H 13/86* (2013.01); *H01H 13/84* (2013.01); *H01H 13/88* (2013.01); *H01H 2217/004* (2013.01); *H01H 2221/078* (2013.01); *H01H 2223/04* (2013.01)

(58) Field of Classification Search
CPC .... H01H 13/86; H01H 13/88; H01H 2223/04; H01H 2221/078
USPC ..... 200/302.2, 520, 522, 341
See application file for complete search history.

(56) References Cited

U.S. PATENT DOCUMENTS 6,494,615 B2 * 12/2002 Wyssbrod ..... G04B 3/048 200/341
9,666,387 B2 5/2017 Sheng
2012/0160640 A1 * 6/2012 Aldana ..... H01H 13/85 200/293
2016/0233034 A1 8/2016 Sheng

FOREIGN PATENT DOCUMENTS

CN 203691479 U 7/2014
CN 203983097 U 12/2014
CN 105120041 A 12/2015
CN 105609351 A 5/2016
CN 105788923 A 7/2016

* cited by examiner

*Primary Examiner* — Edwin A. Leon
*Assistant Examiner* — Lheiren Mae A Caroc
(74) *Attorney, Agent, or Firm* — ScienBiziP, P.C.

(57) ABSTRACT

A button structure includes a button and a fixing portion; wherein the fixing portion is configured for fixing the button, the fixing portion includes a first latching portion and a second latching portion, and the first latching portion includes a first latching opening, and the second latching portion includes a second latching opening, and the first latching opening has an opening direction substantially perpendicular to an opening direction of the second latching opening, and the first latching opening and the second latching opening are engaged with the button. An electronic device is also provided. The electronic device includes a housing and the button structure, the button structure is received in the housing.

17 Claims, 4 Drawing Sheets

BUTTON STRUCTURE AND ELECTRONIC DEVICE USING SAME

FIELD

The present disclosure relates to modular electronic technology, and more particularly to a button structure.

BACKGROUND

Electronic devices have become lighter and thinner, but rapid disassembly and installation of electronic components is still required. The small fasteners presently used to fix a button body need special tools, which is not convenient for installation and disassembly. Therefore, there is a room for improvement within the art.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
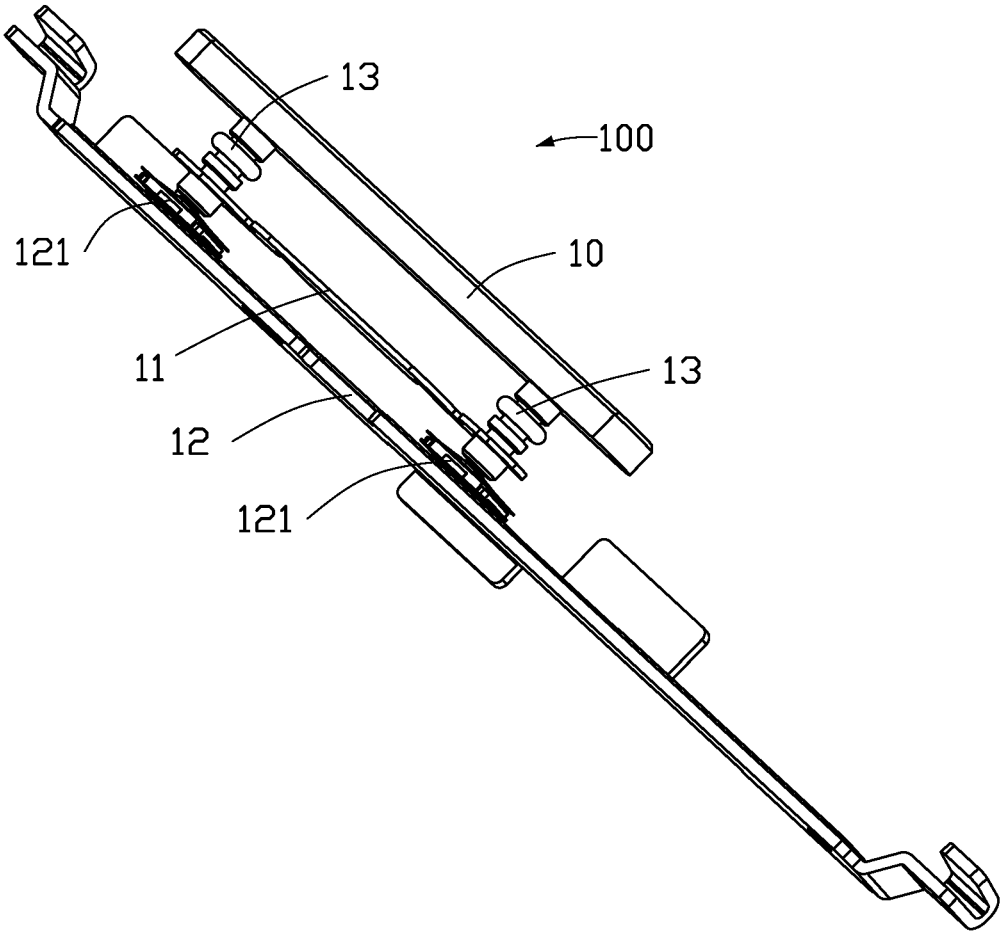
FIG. 1 is a schematic view of an embodiment of a button structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The term "comprising" means "including, but not necessarily limited to"; it specifically indicates open-ended inclusion or membership in a so-described combination, group, series, and the like.

Embodiments of the present disclosure will be described in relation to the accompanying drawings.

Figure 6:
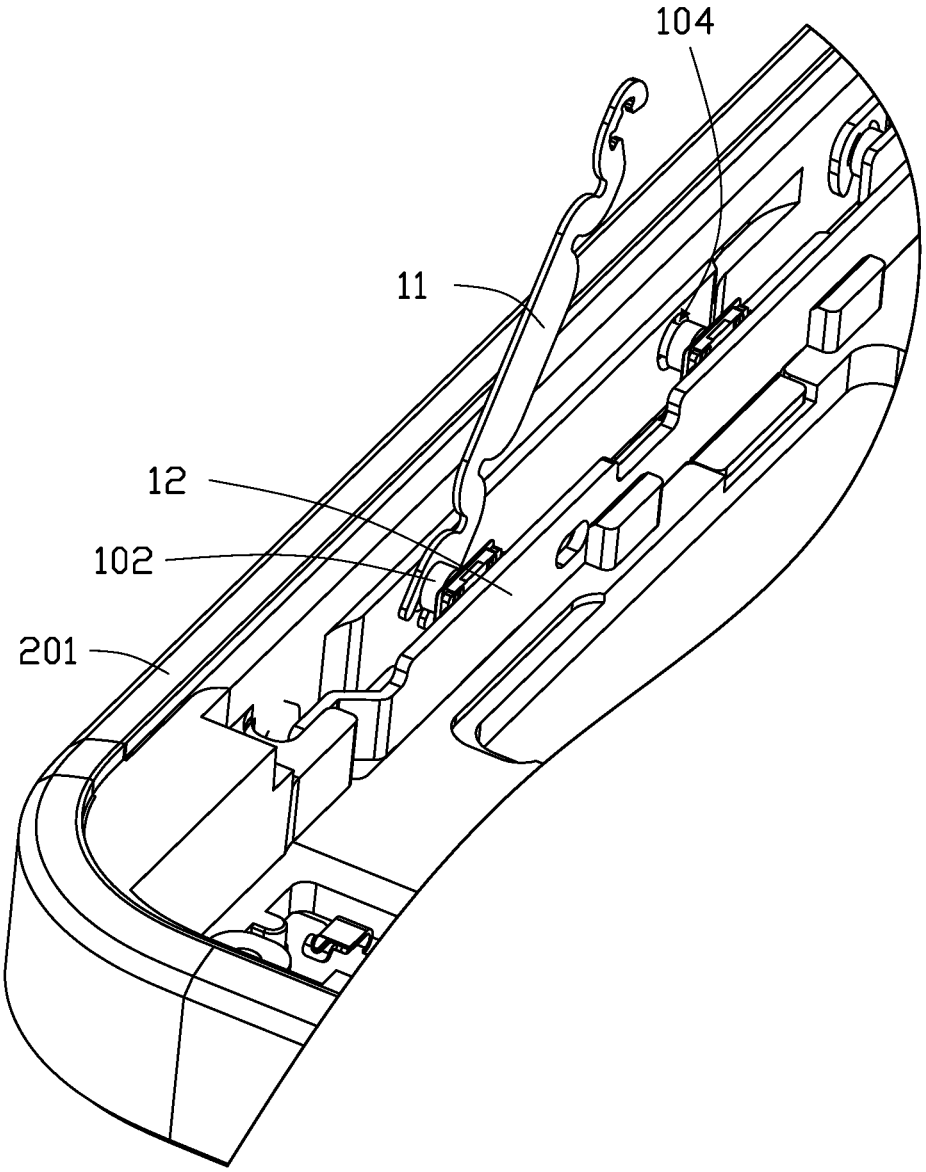
FIG. 6 is a cross-section view of the button structure of FIG. 1 used in an electronic device.

Referring to FIG. 1 and FIG. 6, an electronic device 200 includes a housing 201 and a button structure 100. The button structure 100 is assembled to the housing 201. The electronic device 200 can be a mobile phone, a personal digital assistant, a tablet, a laptop, or other terminal device. The electronic device 200 can further include, but is not limited to, other mechanical structures, electronic components, modules, and software.

In one embodiment, the button structure 100 includes a button 10, a fixing portion 11, a substrate 12, and a sealing element 13. The fixing portion 11 is configured to secure the button 10 to the housing 201. The button 10 is connected to the substrate 12. The sealing element 13 is positioned on the button 10 to seal a gap between the button structure 100 and the housing 201.

Figure 2:
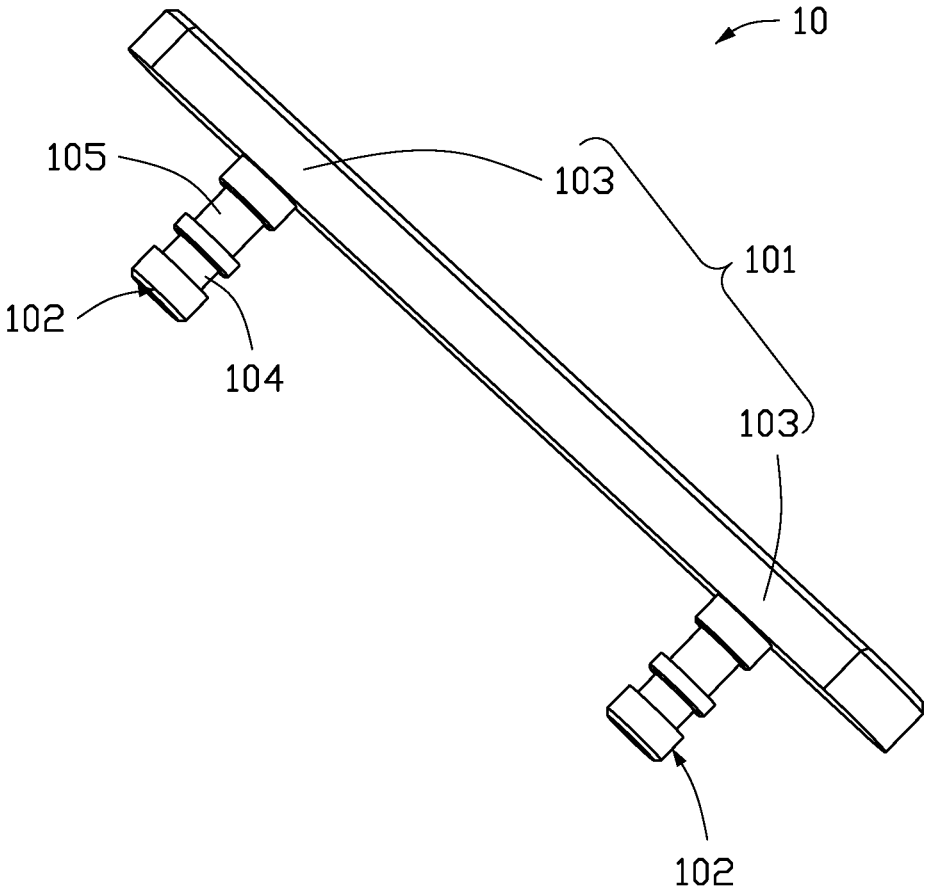
FIG. 2 is a schematic view of an embodiment of the button structure of FIG. 1.

Referring to FIG. 2, the button 10 includes a key portion 101 and two tongues 102 protruding from the keyportion 101. In one embodiment, the key portion 101 preferably includes two keys 103, which are connected to each other. The key 103 can be a volume key mounted on the housing of the electronic device 200. In another exemplary embodiment, the key portion 101 can include one key 103.

In one embodiment, each tongue 102 is a cylindrical structure. The two tongues 102 are preferred symmetrically arranged with respect to a middle point of the key portion 101. Each tongue 102 defines a first groove 104 and a second groove 105. The first groove 104 and the second groove 105 of each tongue 102 are coxially defined around a peripheral surface of the tongue 102. The first groove 104 and the second groove 105 are spaced apart from each other. A width of the first groove 104 is slightly narrower than a width of the second groove 105. The second groove 105 is defined to be near by the key portion 101.

Figure 3:
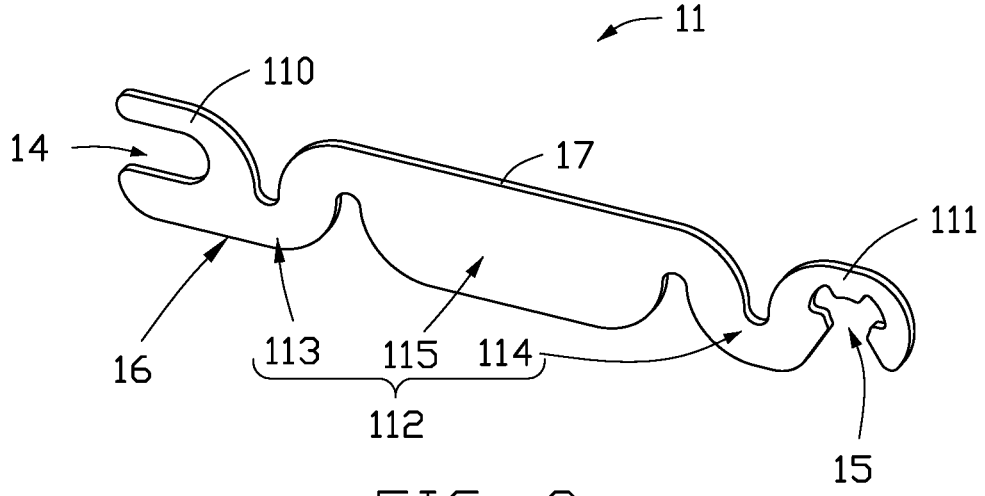
FIG. 3 is a schematic view of an embodiment of a connecting portion of the button structure of FIG. 1.

Referring to FIG. 3, the fixing portion 11 is substantially a long strip-shaped sheet. The fixing portion 11 includes a first latching portion 110, a second latching portion 111, and a connecting portion 112. The connecting portion 112 is configured for connecting the first latching portion 110 and the second latching portion 111. The first latching portion 110 is approximately a U-shaped structure, and defines a first latching opening 14 therein. The second latching portion 111 is approximately a C-shaped structure, and defines a second latching opening 15 therein. The diameter of the entrance of the second latching opening 15 is less than an inner diameter of the second latching opening 15. The first latching opening 14 has an opening direction substantially perpendicular to an opening direction of the second latching opening 15. For example, the opening direction of the first latching opening 14 is oriented horizontally, and the opening direction of the second latching opening 15 is oriented vertically. The first latching opening 14 is engaged with the first groove 104 of one tongue 102, and the second latching opening 15 is engaged with the first groove 104 of the other tongue 102. Namely, the first grooves 104 of the two tongues 102 are configured for respectively receiving the first latching opening 14 and the second latching opening 15.

In one embodiment, the connecting portion 112 includes a first elastic portion 113, a second elastic portion 114, and a sub-connecting portion 115. The sub-connecting portion 115 is substantially a long strip-shaped structure. The first elastic portion 113 is connected between the sub-connecting portion 115 and the first latching portion 110. The second elastic portion 114 is connected between the sub-connecting portion 115 and the second latching portion 111. The first elastic portion 113 and the second elastic portion 114 are planar S-shaped structures.

In one embodiment, the connecting portion 112 further includes a first lateral side 16 and a second lateral side 17, and a plurality of notches 116. The first lateral side 16 and the second lateral side 17 are opposite sides of the connecting portion 112. The plurality of notches 116 are alternately formed on the first lateral side 16 and the second lateral side 17. A notch 116 can be defined at a position near the first latching portion 110, and on the first lateral side 16. The plurality of notches 116 can be formed on the second lateral side 17, alternating with those on the first lateral side 16, to form the first elastic portion 113. A notch 116 can be at a position near the second latching portion 111, alternating with those on the opposite side. The plurality of notches 116 can form the second elastic portion 114. The first elastic portion 113 and the second elastic portion 114 are resiliently deformable.

Figure 4:
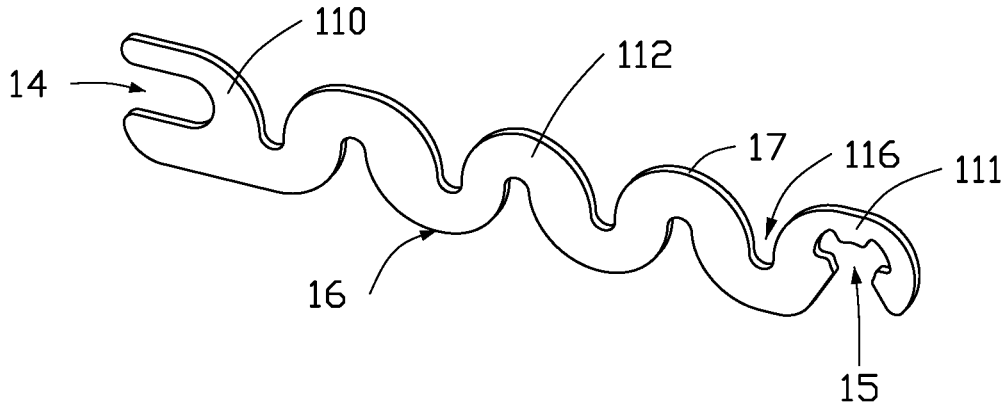
FIG. 4 is a schematic view of another embodiment of a connecting portion.

In a second embodiment, referring to FIG. 4, the connecting portion 112 is a wave-shaped structure. The connecting portion 112 includes the first lateral side 16 and the second lateral side 17 and the plurality of notches 116 defined therein, the connecting portion 112 being opposite to the second lateral side 17. The plurality of notch 116 are alternately formed on the first lateral side 16 and the second lateral side 17 to form the connecting portion 112. The notch 116 defined immediately next to the second latching opening 15 has an opening which is opposite to the opening of the second latching opening 15.

Figure 5:
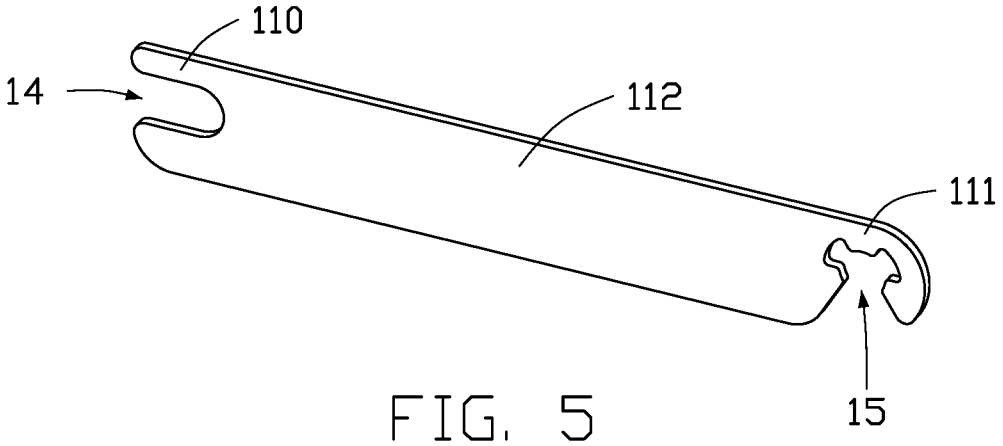
FIG. 5 is a schematic view of another embodiment of a connecting portion.

In a third embodiment, referring to FIG. 5, the connecting portion 112 is a long strip-shaped structure. The first elastic portion 113 and the second elastic portion 114 can in that case be omitted.

One end of the two tongues 102 near the first groove 104 are connected to the substrate 12. In one embodiment, the substrate 12 can be flexible circuit board (FPC). The substrate 12 is provided with a switching circuit. The substrate 12 includes two trigger switches 121. One end of each of the two tongues 102 is connected to one of the two trigger switches 121. The other end of each of the two tongues 102 is connected to the key portion 101. When a user presses the key portion 101, the tongue 102 presses the trigger switch 121 to activate a switching circuit for a function. The function can include, but is not limited to, increasing and decreasing volume, brightening and dimming display screen, and so on.

The sealing element 13 is an O-ring. The sealing element 13 is made of resilient material, such as rubber or silicon material. The second groove 105 of each tongue 102 is configured for receiving a sealing element 13. A sealing element 13 is disposed in each hole of the housing 201 of the electronic device 200, the holes being configured to receive the tongue 102. The sealing element 13 seals the gap between the electronic device 200 and the button 10, thereby achieving waterproofing of the button structure 100.

In one embodiment, referring to FIG. 6, in installation, the two sealing elements 13 are firstly assembled into the two second grooves 105 of the two tongues 102. Then the two tongues 102 are inserted into the two holes of the electronic device 200. Then, the first latching opening 14 is engaged with the first groove 104 of one tongue 102, and the second latching portion 15 is rotated towards to the other tongue 102 to engage the second latching opening 15 with the first groove 104 of the other tongue 102.

After installation, the key portion 101 is positioned outside of the electronic device 200, and the fixing portion 11 is arranged inside of the electronic device 200, so that, the button 10 can be fixed to the housing 201.

During disassembly, the second latching opening 15 is firstly pulled out from the first groove 104 of one tongue 102. Then the fixing portion 11 is rotated upward until the first latching opening 14 can be moved out from the first groove 104 of the other tongue 102. The installation and disassembly of this part of an electronic device can be done directly by hand without special tools.

The latchability of the first latching opening 14 and the second latching opening 15 is such that the installer can conveniently install and disassemble without tools. The first elastic portion 113 and the second elastic portion 114 operate virtually independently so that a resistance to deformation under another key 103 is maintained, and the touch of the key 103 is improved.

The embodiments shown and described above are only examples. Many details are often found in the art such as the other features of a button structure. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A button structure, comprising:

a button; and a fixing portion comprising:

a first latching portion; and a second latching portion;

wherein the fixing portion is configured for securing the button, and the first latching portion comprises a first latching opening, and the second latching portion comprises a second latching opening, and the first latching opening has an opening direction substantially perpendicular to an opening direction of the second latching opening, and the first latching opening and the second latching opening are engaged with the button;

wherein the button comprises a key portion and two tongues, the two tongues protrude from the key portion, and the first latching opening is engaged with one said tongue, and the second latching opening is engaged with the other said tongue;

wherein each said tongue is a cylindrical structure defining a first groove and a second groove, the first groove and the second groove of each said tongue are coaxially defined around a peripheral surface of the tongue, the first groove and the second groove are spaced apart from each other, the first grooves of the two tongues are configured for respectively receiving the first latching opening and the second latching opening, and the second groove of each said tongue is configured for receiving a sealing element.

2. The button structure of claim 1, wherein the fixing portion further comprises a connecting portion, and the connecting portion is configured for connecting the first latching portion and the second latching portion, the opening direction of the first latching opening is oriented horizontally, and the opening direction of the second latching opening is oriented vertically.

3. The button structure of claim 2, wherein the connecting portion comprises a first elastic portion and a second elastic portion, the first elastic portion is connected to the first latching portion, the second elastic portion is connected to the second latching portion, and the first elastic portion and the second elastic portion are resiliently deformable.

4. The button structure of claim 3, wherein the first elastic portion and the second elastic portion are planar S-shaped structures.

5. The button structure of claim 3, wherein the connecting portion further comprises a sub-connecting portion, the sub-connecting portion is substantially a long strip-shaped structure, and the sub-connecting portion is connected between the first elastic portion and the second elastic portion.

6. The button structure of claim 2, wherein the connecting portion further comprises a first lateral side and a second lateral side, the first lateral side and the second lateral side are opposite sides of the connecting portion.

7. The button structure of claim 6, wherein a plurality of notches are alternately formed on the first lateral side and the second lateral side to form the connecting portion, and the connecting portion is a wave-shaped structure.

8. The button structure of claim 2, wherein the connecting portion is a long strip-shaped structure.

9. The button structure of claim 1, wherein the first latching portion is approximately a U-shaped structure, and the second latching portion is approximately a C-shaped structure.

10. The button structure of claim 1, wherein the button structure further comprises a substrate, the substrate comprises two trigger switches, and the two tongues are connected between the key portion and the trigger switches.

11. The button structure of claim 1, wherein the sealing element is an O-ring, and the sealing element is made of resilient material.

12. An electronic device, comprising:

a housing; and a button structure comprising:

a button; and a fixing portion comprising:

a first latching portion; and a second latching portion;

wherein the button structure is received in the housing; the fixing portion is configured for securing the button, and the first latching portion comprises a first latching opening, and the second latching portion comprises a second latching opening, and the first latching opening has an opening direction substantially perpendicular to an opening direction of the second latching opening, and the first latching opening and the second latching opening are engaged with the button;

wherein each said tongue is a cylindrical structure defining a first groove and a second groove, the first groove and the second groove of each said tongue are coaxially defined around a peripheral surface of the tongue, the first groove and the second groove are spaced apart from each other, the first grooves of the two tongues are configured for respectively receiving the first latching opening and the second latching opening, and the second groove of each said tongue is configured for receiving a sealing element, and the sealing element is an O-ring, and the sealing element is made of resilient material.

13. The electronic device of claim 12, wherein the button comprises a key portion and two tongues, the two tongues protrude from the key portion, and the first latching opening is engaged with one said tongue, and the second latching opening is engaged with the other said tongue.

14. The electronic device of claim 13, wherein the button structure further comprises a substrate, the substrate comprises two trigger switches, and the two tongues are connected between the key portion and the trigger switches.

15. The electronic device of claim 12, wherein the fixing portion further comprises a connecting portion, and the connecting portion is configured for connecting the first latching portion and the second latching portion, and the opening direction of the first latching opening is oriented horizontally, and the opening direction of the second latching opening is oriented vertically, the first latching portion is approximately a U-shaped structure, and the second latching portion is approximately a C-shaped structure.

16. The electronic device of claim 15, wherein the connecting portion comprises a first elastic portion and a second elastic portion, the first elastic portion is connected to the first latching portion, the second elastic portion is connected to the second latching portion, and the first elastic portion and the second elastic portion are resiliently deformable, the first elastic portion and the second elastic portion are planar S-shaped structures.

17. The electronic device of claim 16, wherein the connecting portion further comprises a sub-connecting portion, a first lateral side, a second lateral side and a plurality of notches, the sub-connecting portion is substantially a long strip-shaped structure, and the sub-connecting portion is connected between the first elastic portion and the second elastic portion, the first lateral side and the second lateral side are opposite sides of the connecting portion, and the plurality of notches are alternately formed on the first lateral side and the second lateral side to form the connecting portion, and the connecting portion is a wave-shaped structure, the connecting portion is a long strip-shaped structure.

* * * * *